United States Patent [19]

DeLong et al.

[11] 4,381,444

[45] Apr. 26, 1983

[54] RANGE SURFACE UNIT RECEPTACLE

[75] Inventors: Ronald B. DeLong, Lowell; Alvin J. Schettl, Kentwood, both of Mich.

[73] Assignee: White Consolidated Industries, Inc., Cleveland, Ohio

[21] Appl. No.: 303,047

[22] Filed: Sep. 17, 1981

[51] Int. Cl.[3] ..... H05B 3/68

[52] U.S. Cl. ..... 219/451; 219/447; 219/541; 339/14 RP; 339/65

[58] Field of Search ..... 219/447, 451, 452, 453, 219/455, 463, 467, 507, 536, 537, 541; 338/322; 339/14 RP, 65, 191 R, 192 RL

[56] References Cited

U.S. PATENT DOCUMENTS

| | | | |
|---|---|---|---|
| 2,234,132 | 3/1941 | Simpson | 219/451 |
| 2,325,358 | 7/1943 | Andrews | 219/463 |
| 2,414,667 | 1/1947 | Price | 219/451 X |
| 2,472,738 | 6/1949 | Bacher | 339/136 |
| 2,547,058 | 4/1951 | Sutten | 339/192 RL |
| 2,565,432 | 8/1951 | Kirk | 219/463 |
| 2,810,056 | 10/1957 | Aldous | 219/451 |
| 2,839,656 | 6/1958 | Weyrick | 219/451 |
| 3,016,444 | 1/1962 | Jasionowski | 219/451 |
| 3,021,414 | 2/1962 | Sand | 219/451 |
| 3,051,817 | 8/1962 | Pearce et al. | 219/463 |
| 3,197,617 | 7/1965 | Gillespie et al. | 219/541 |
| 3,327,095 | 6/1967 | Hanson | 219/451 |
| 3,466,427 | 9/1969 | Burger | 219/451 |
| 3,569,671 | 3/1971 | Henning et al. | 219/541 |
| 3,571,562 | 3/1971 | Cunningham | 219/451 |
| 3,696,232 | 10/1972 | Salinger | 219/451 |
| 3,750,092 | 7/1973 | Bury | 339/192 RL |
| 3,767,897 | 10/1973 | Prucha | 219/451 |
| 4,013,870 | 3/1977 | Summers | 219/451 |

*Primary Examiner*—Volodymyr Y. Mayewsky
*Attorney, Agent, or Firm*—Pearne, Gordon, Sessions, McCoy, Granger & Tilberry

[57] ABSTRACT

The spadelike terminal pins of a conventional plug-in surface heating element for a domestic range of the electric type are received in a socket member hingedly mounted to the range by a clip structure including a spring-biased pin joint. The clip structure allows the heating element, normally nested within and supported by a drip pan, to be tilted upwardly and then unplugged from the socket to permit ready removal of the drip pan for cleaning purposes. Spring-biasing of the clip structure aids in retaining the heating element at its normal position within the drip pan. The spring-biased pin joint is shielded from the radiant heat generated by the heating element to minimize the deteriorating effects of repeated thermal expansion and contraction cycles.

8 Claims, 4 Drawing Figures

Fig.-1
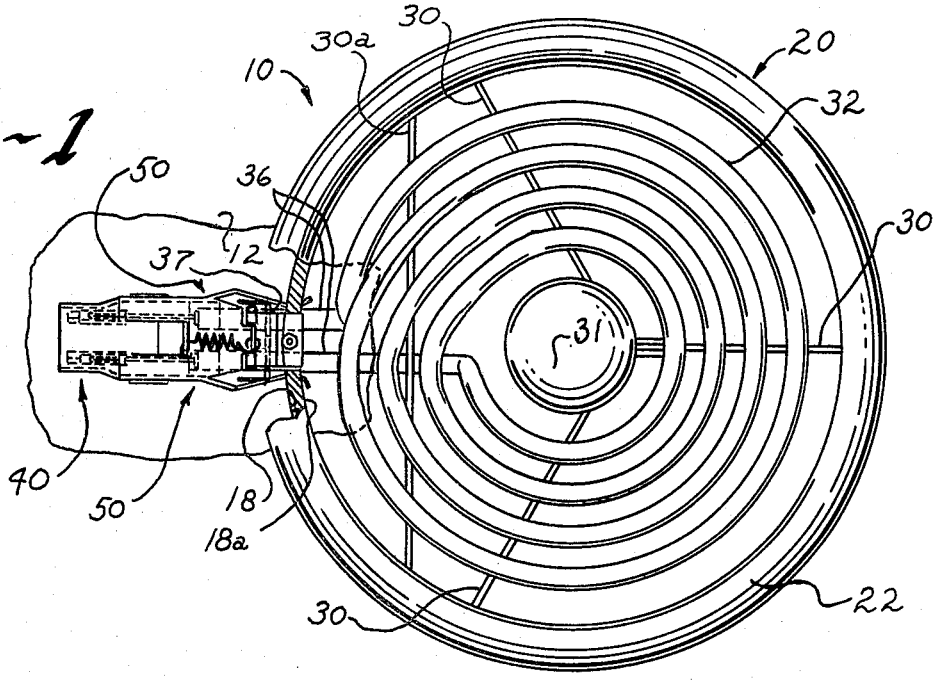
Fig.-3
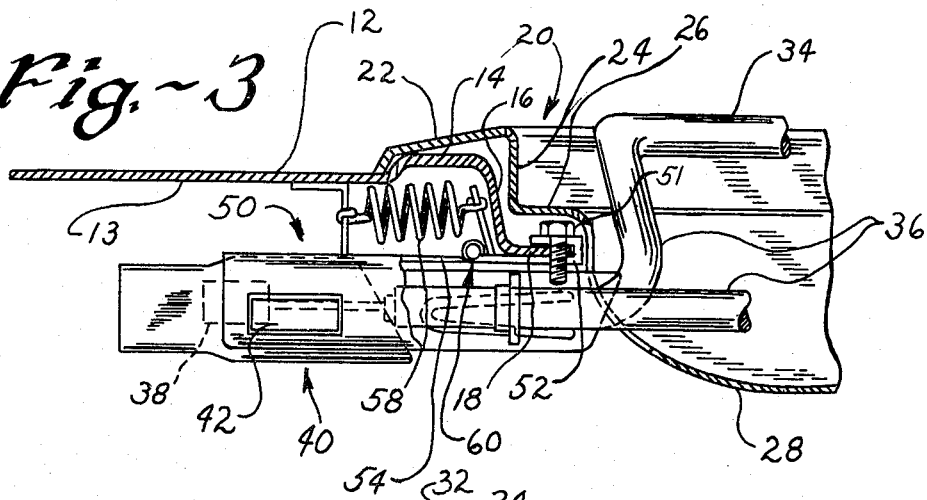
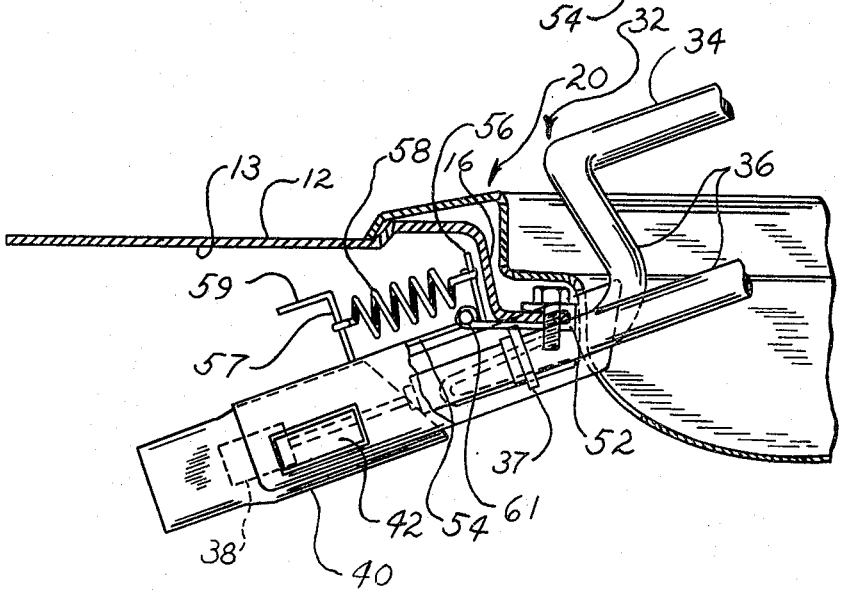
Fig.-4

RANGE SURFACE UNIT RECEPTACLE

BACKGROUND OF THE INVENTION

The present invention relates in general to electrical connectors, and in particular to a clip for hingedly supporting a socket beneath the cooking platform of an electric range, a removable surface heating element plugging into the socket.

It is known in the art to provide a plurality of hinge-mounted sockets beneath the cooking platform of a domestic range of the electric type, each socket being electrically connected to a plug-in type surface heating element supported by a bowl-like drip pan nested in an aperture in the cooking platform. Two or more rigid terminal pin portions of the heating element project downwardly from the heating surface of the circular element and then extend radially outwardly through the apertured sidewall of the drip pan in a horizontal direction for engagement with the socket.

To facilitate cleaning of the cooking platform, the drip pan, and the range surfaces beneath the drip pan, the heating unit is tilted upwardly out of its nested position within the drip pan and then unplugged. Pivotal movement of the associated hinge-mounted socket permits the noted tilting and removal of the heating element to in turn permit removal of the drip pan.

Over the relatively long life of a domestic range of the type under consideration, the clip structure for hingedly mounting the heating element socket to the cooking platform can be subjected to repeated thermal expansion and contraction cycles that may eventually cause failure of the clip structure. Thus, long term reliability is an important concern in designing a suitable clip structure. Further, merely designing a heavy duty clip structure to handle the noted thermal cycles is not a plausible solution, since the increased cost of such a heavy duty clip structure would not be acceptable in the highly competitive domestic appliance business. It is also desirable that the clip structure be of a simple design which not only permits upward tilting and removal of the associated heating element but also provides spring biasing of the heating element downwardly into and against the drip pan to maintain the associated heating element in a normal horizontal position generally parallel with the cooking platform even after repeatedly removing and reinstalling the heating element over the lifetime of the range.

SUMMARY OF THE INVENTION

In accordance with the present invention, a clip structure, mounted to the cooking platform of a domestic range of the electric type, is adapted to receive and hingedly support a socket member engageable with the terminal pins of an electrical resistance type surface heating unit. The clip structure includes a fixed hinge portion fastened to the range platform and a movable hinge portion hingedly connected to the fixed hinge portion and movable relative thereto, the movable hinge portion being adapted to receive and support the socket member. A spring member biases the hinge portions at a normal position relative to each other. A section of the cooking platform is positioned between the spring member and the normal position of the heating surface of the heating element to shield the spring member from radiant heat generated by the heating surface of the heating element.

In a preferred form, the hinged connection between the hinge portions is constituted by a pin joint that is also shielded from radiant heat by a section of the cooking platform. Preferably, the shielding section of the cooking platform is integrally formed with the remainder of the cooking platform, which acts as a heat sink to minimize the temperature of the shielding sections.

The clip structure in accordance with the invention, while low in material and manufacturing cost, has proved to be extremely rugged and reliable.

BRIEF DESCRIPTION OF THE DRAWINGS

FIG. 1 is a plan view, with portion cut away, of a "burner" location of domestic range of the electric type;

FIG. 3 is an elevational cross-sectional view of a portion of the "burner" unit of FIG. 1, illustrating the socket retaining clip structure of FIG. 2 in accordance with the present invention, the socket being connected to a conventional resistance type surface heating element shown at its normal cooking position; and FIG. 4 is similar to the view of FIG. 2, with the burner element shown in a raised or tilted position for removal, the socket member swinging downwardly as illustrated.

DETAILED DESCRIPTION OF THE PREFERRED EMBODIMENT

Figure 2:
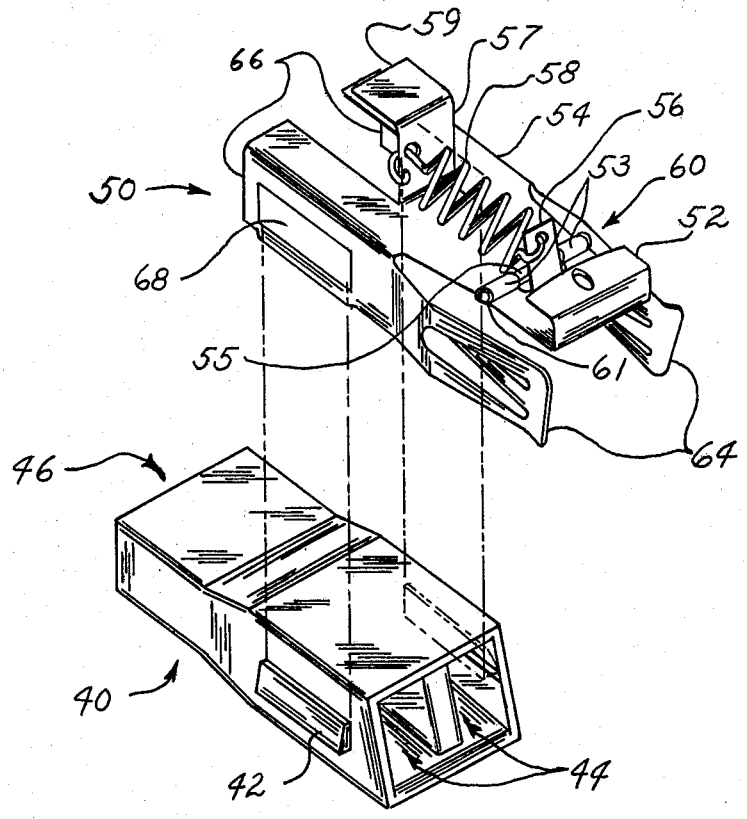
FIG. 2 is an exploded, perspective view of the mounting clip of the present invention and a conventional socket member received and supported by the mounting clip.

With reference to the drawings, and in particular to FIG. 1 thereof, a circular "burner" location 10 of a typical domestic range of the electric type is illustrated. In a conventional fashion, an enameled sheet metal, horizontal cooking platform 12, typically of rectangular form having four symmetrically oriented "burner" locations (only one being illustrated in FIG. 1), supports at each location a bowl-like sheet metal drip pan 20 that is supported at its outer peripheral edge and fits down into a circular aperture in the cooking platform 12. The circular aperture is defined in part by a horizontal ring-like flange 18 provided by the cooking platform 12, the inner edge 18*a* of which constitutes an outer periphery of the aperture down into which the bottom portion of bowl-like drip pan 20 extends.

Nested within and supported by the drip pan 20 is a helically wound resistance wire heating element 32 of a conventional type. The element 32 rests on and is fastened to a spider member having three radially extending leg portions 30 (and a crosspiece 30*a*) that in turn rest on and nest in the upper area of the bowllike drip pan 20. A metal disc 31 fastened to the intersection of the spider leg portions 30 constitutes the center location of the circular burnerlike heating element 32.

The heating element 32 is pancake-shaped, and includes, as illustrated, a pair of generally rigid terminal pin portions 36 that extend downwardly from the general pancake-shaped area of the heating element 32 and then radially outwardly therefrom under the cooking platform 12 in a horizontal direction for engagement with and electrical connection to a conventional socket member 40. The terminal pin portions 36 are parallel to each other and are maintained in parallel relation by a spacer clip 37.

The socket member 40 is received and hingedly supported by a mounting clip structure 50, which in turn is fastened to the horizontal ringlike flange 18, to be subsequently discussed and illustrated in detail.

With reference to FIG. 2, there is illustrated in perspective view the clip structure 50 for hingedly mounting the socket 40 in position under the cooking platform 12 (see FIG. 1). As illustrated in FIG. 2, the clip structure 50 includes a fixed hinge portion 52 having a pair of fixed pin receiving bushings 53 spaced from each other and axially aligned to receive a hinge pin 61. The clip structure 50 further includes a movable hinge portion 54 providing a pivoting pin bushing center section 55 axially aligned between the two fixed pin-receiving bushings 53 provided by the fixed hinge portion 52, the pin 61 extending through and hingedly connecting the portions 52, 54 together. A hinge connection 60 thus provides limited pivotal movement of the portion 54 about the fixed axis of revolution provided by the pin 61. The movable hinge portions 54 include a pair of conventional, downwardly extending, clip arms or legs 66 for retaining the socket 40, the legs each having a tab receiving aperture 68 (only one shown), the arms 66 being parallel to each other and spaced and sized to receive the socket 40 that is pushed upwardly and clipped between the arms 66 by a pair of tapered locking tabs 42 (only one shown) sliding up and locking into the apertures 68. The forward end (or right end as viewed in FIG. 2) of the legs 66 provide a pair of conventional burner element retaining clip fingers 64 sized to receive and engage the outside edges of the spacer clip 37 (see FIG. 1), spadelike terminal pins 38 (see FIGS. 3 and 4; only one shown) being received into the female receptacle portions 44 of the socket member 40 as illustrated in FIG. 2, the rearward end 46 of the socket 40 being connected by wires to an electrical power source for the associated surface heating element. The socket member 40 is of a conventional type, manufactured and sold by Molex Incorporated of Lisle, Ill., U.S.A. (see also U.S. Pat. No. 3,750,092).

Extending upwardly from the fixed hinge portion 52 is a first projection 56 constituting a fixed support arm connected to one end of a biasing spring 58 having its other end connected to a second upwardly extending projection 57 provided by the movable hinge portion 54. The projections 56, 57 serve to maintain the spring 58 in spaced relation from other hinge and range elements to minimize its heating by such elements via thermal conductivity. Also, air circulates about the spring 58 to minimize its temperature. Thus, the elasticity of the spring will remain constant, since the deleterious effects of the heating and cooling cycles are minimized. Included at the upper end of the second projection 57 is a stop 59 which engages with the underside of the cooking platform 12 (see FIG. 3) in a manner to be subsequently discussed. The clip structure 50 is preferably formed of a light gauge, springlike sheet metal so that upon insertion of the burner element into the socket 40, the springlike pair of burner element clip fingers 64 can spread apart slightly to receive the spacer clip 37 (see FIG. 1), which slides back into and is retained between the fingers 64.

The interconnection of the socket member 40, the clip structure 50, the burner element 32, and the cooking platform 12 is more clearly illustrated with reference to FIG. 3. As illustrated in FIG. 3, the cooking platform 12 is deformed by an appropriate stamping operation to define a circular raised lip portion 14 that extends horizontally inwardly towards the center of the burner location. The radially inner edge of the raised lip portion 14 has extending downwardly from it a circular rim 16 extending around the edge of the heating element 32, the lower end of the rim 16 providing the horizontal ringlike flange 18. The fixed hinge portion 52, having a U-shaped cross section, clips over and is fastened to the horizontal ringlike flange 18 by a suitable screwtype fastener 51 that, for example, threads into the flange 18 to fix the hinge portion 52 into position relative to the remainder of the cooking platform 12, the hinge connection 60 being immediately adjacent the intersection of the rim 16 and the flange 18 as illustrated.

The bowl-like drip pan 20 is further illustrated as including a support ring portion 22 defining the periphery of the burner location 10, as illustrated in FIG. 1, the radially inward edge of the circular support ring portion 22 providing a downwardly extending vertical lip 24 whose lower end provides an inwardly radially extending spider support shelf 26. From the inner edge of the spider support shelf 26, a bowl-shaped underlying pan portion 28 is supported, the pan portion collecting dripped food and the like from cooking utensils placed upon the burner element 32. It is to be noted that, as illustrated in FIG. 3, the drip pan 20, including elements 22, 24, 26, and 28, is formed integrally from a single sheet of metal by conventional stamping operations during which an aperture is provided in the sidewall of the pan portion 28, such aperture permitting the terminal pin portions 36 of the heating element 32 (FIG. 1) to extend radially outwardly through the sidewall of the pan portion 28, the terminal clips 38 (only one shown) being received into the socket 40, the socket 40 being supported by the movable hinge portion 54 hingedly connected to the fixed hinge portion 52 fastened to the horizontal flange 18. It is also noted that the drip pan 20 may be constituted by plural components, e.g., a separate pan portion and a separate support ring portion, as is well known in the art.

As illustrated in FIG. 3, a pancake-shaped heating surface 34 of the heating unit 32 (FIG. 1) is generally parallel to and spaced slightly above the horizontal cooking platform 12. The biasing spring 58 (under slight tension) and the pin joint 60 are separated from the heat-radiating surface 34 by the interposed section of the rim 16 (and the drip pan portions 24, 26) so as to shield the pin joint and the spring 58 from heat generated by the heating element. Preferably, the circular rim 16, the associated lip 14 and the flange 18 are integrally formed from a single piece of sheet metal along with the cooking platform 12. Such a structure permits the cooking platform 12, the lip 14, and the flange 18 to act as a heat sink relative to the circular rim 16 interposed between the spring 58 and pin joint hinge connection 60, and the heating element heat radiating surface 34 so as to control and minimize the temperature of the interposed rim portion 16 and thus minimize the highest temperature of the biasing spring 58 and the pin joint 60 reached during normal range operations. Thus, in accordance with the invention, the pin joint hinge connection 60 and spring 58 are positioned in a shielded location to minimize the deteriorating effect of thermal expansion and contraction cycles that could be caused by radiated heat from the highly heated surface 34.

Turning to FIG. 4, the heating element 32 is shown in a raised position, wherein it can be unplugged from the socket 40 to permit removal of the drip pan 20 for cleaning purposes. It can be seen that the socket 40 moves and pivots downwardly about the axis provided by interconnecting hinge pin 61, wherein the stop 59 moves away from the underside 13 of the range cooking platform 12, the biasing spring 58 being put under further tension. When the heating element 32 is pulled out of the socket, the force of the biasing springs 58 will snap the socket and the connected movable hinge portions 54 back into a normal position, as illustrated in FIG. 3, with the stop 59 engaging the underside 13 of the cooking platform 12. In reinserting the heating element 32, the terminal pin portions 36 (including spadelike terminal pins 38) of the heating element are partially inserted into the socket, and then the element is tilted upwardly, as illustrated in FIG. 4. The terminal pin element portions 34 are then pushed completely into the socket 40 so that the heating element 32 on the spider leg portions 30,30*a* (FIG. 1) can be fitted down into the drip pan 20, the biasing spring 58 holding the legs 30 down against and in engagement with the ringlike spider support shelf 26, as illustrated in FIG. 3.

It can be seen that only the forward edge of the fixed hinge portion 52 is directly exposed to radiant heat from the burner element 32, transmitted, for the most part, via the aperture in the sidewall drip pan portion 28, permitting passage of the terminal pin portions 36. Thus, the heat shielding effect of the heat sinked rim portion 16, and to a lesser extent the adjacent side wall of the pan portion 28, insulate the movable hinge element 54, the biasing spring 58, and the pin joint hinge connection 60 from high temperatures that could eventually cause failure of the hinge clip 50.

Although the preferred embodiment of this invention has been shown and described, it should be understood that various modifications and rearrangements of the parts may be resorted to without departing from the scope of the invention as disclosed and claimed herein.

What is claimed is:

1. In a domestic range of the electric type having a horizontal cooking platform supporting at least one electrical resistance type surface heating element, a clip structure for receiving and supporting a socket member engageable with the terminal pins of the electrical resistance type surface heating element, the clip structure comprising:

a fixed hinge portion fastened to the cooking platform;

a movable hinge portion hingedly connected to the fixed hinge portion and movable relative thereto, the movable hinge portion being adapted to receive and support the socket member; and a spring member connected between the hinge portions, the spring member biasing the hinge portions at a normal heating position relative to each other, a section of the cooking platform being positioned between the spring member and the heating surface of the heating element at its normal heating position, the section shielding the spring member from radiant heat generated by the heating surface of the heating element, the fixed hinge portion including a first projection, the movable hinge portion including a second projection, the spring member being connected between the projections and supported by the projections in spaced relation from the remainder of the hinge portions at their normal positions to minimize thermal conductivity between the hinge portions and the spring member.

2. An apparatus according to claim 1, wherein said section of the cooking platform shielding the spring member is interposed between the hinge connection area of the hinge portions and the heating surface of the heating element at its normal heating position, said section shielding the hinge connection area from radiant heat generated by the heating surface of the heating element.

3. An apparatus according to claims 1 or 2, wherein the cooking platform including said section is formed of sheet metal, radiant heating of the section by the heating element being controlled by transfer of heat from said section to the remainder of the cooking platform functioning as a heat sink to minimize the temperature of the said section.

4. An apparatus according to claim 3, wherein the cooking platform including said section is integrally formed from a single piece of sheet metal.

5. In a domestic range of the electric type having a horizontal cooking platform including at least one aperture defined by a horizontal ringlike flange extending inwardly from the lower end of a circular rim projecting generally downwardly from the cooking platform to define the periphery of the aperture, a bowl-like drip pan being nested within the aperture and supported by the cooking platform, an electric resistance type surface heating element being normally positioned in and supported by the drip pan, the heating element including at least two terminal pins extending through the drip pan for engagement with a socket member positioned below the cooking platform adjacent to the aperture, a clip structure for receiving and supporting the socket member comprising:

a fixed hinge portion fastened to the horizontal ringlike flange, the fixed hinge portion providing a first projection extending upwardly above the level of the horizontal ringlike flange, a section of the circular rim being located between the first projection and the heating element;

a movable hinge portion hingedly connected to the fixed hinge portion and movable relative thereto, the movable hinge portion including a pair of downwardly extending springlike clip arms, the socket being snapped into and between the clip arms and retained therein, the movable hinge portion providing a second projection extending upwardly above the level of the horizontal flange when the heating element is at its normal position, said section of the circular rim being located between the second projection and the heating element; and an elongated, spirally wound spring member having one end connected to the first projection and the other end connected to the second projection, said section of the circular rim shielding the spring member from radiant heat generated by the heating surface of the heating element, the spring member connected between the projections being spaced from the remainder of the hinge portions.

6. An apparatus according to claim 5, wherein the hinge connection between the fixed and movable hinge portions is constituted by a pin joint, the pin joint being located adjacent the outer edge of the horizontal ringlike flange, said section of the circular rim being interposed between the pin joint from radiant heat generated by the heating surface of the heating element.

7. An apparatus according to claim 5, wherein the spring member is normally under tension tending to move the movable hinge portion upwardly against the underside of the horizontal cooking platform, the heating element coupled to the socket supported by the movable hinge portion being held against and biased toward the drip pan underlying the heating element, upward movement of the heating element placing the spring member under increased tension.

8. Apparatus according to claim 7, including a stop means at the upper end of the second projection engageable with the underside of the cooking platform to limit movement of the movable hinge portion toward the underside of the cooking platform, such movement being caused by the biasing effect of the spring member.

* * * * *